US009777577B2

(12) United States Patent
Brandl et al.

(10) Patent No.: US 9,777,577 B2
(45) Date of Patent: Oct. 3, 2017

(54) COMPONENT FOR A THERMAL MACHINE, IN PARTICULAR A GAS TURBINE

(71) Applicant: ALSTOM Technology Ltd, Baden (CH)

(72) Inventors: Herbert Brandl, Waldshut-Tiengen (DE); Joerg Krueckels, Birmenstorf (CH); Felix Reinert, Wettingen (CH)

(73) Assignee: ANSALDO ENERGIA IP UK LIMITED, London (GB)

( * ) Notice: Subject to any disclaimer, the term of this patent is extended or adjusted under 35 U.S.C. 154(b) by 355 days.

(21) Appl. No.: 14/445,346

(22) Filed: Jul. 29, 2014

(65) Prior Publication Data

US 2014/0334914 A1 Nov. 13, 2014

Related U.S. Application Data

(63) Continuation of application No. PCT/EP2013/053116, filed on Feb. 15, 2013.

(30) Foreign Application Priority Data

Feb. 17, 2012 (CH) ..... 0210/12

(51) Int. Cl.
*F01D 5/18* (2006.01)
*F01D 5/08* (2006.01)
*F01D 25/12* (2006.01)

(52) U.S. Cl.
CPC ..... *F01D 5/081* (2013.01); *F01D 5/085* (2013.01); *F01D 5/186* (2013.01); *F01D 5/187* (2013.01);
(Continued)

(58) Field of Classification Search
CPC ..... F01D 5/085; F01D 5/186; F01D 5/187; F01D 25/12; F05D 2240/81; F05D 2260/20; F05D 2260/204; F05D 2260/208
See application file for complete search history.

(56) References Cited

U.S. PATENT DOCUMENTS 4,156,582 A 5/1979 Anderson
4,311,433 A 1/1982 Bratton et al.
(Continued)

FOREIGN PATENT DOCUMENTS

DE 19601818 A1 8/1996
EP 1 211 385 A2 5/2002
(Continued)

OTHER PUBLICATIONS

Third Office Action dated Aug. 24, 2016 in corresponding Chinese Patent Application No. 201380009850.1, and an English translation thereof (9 pages).
(Continued)

*Primary Examiner* — Ninh H Nguyen
(74) *Attorney, Agent, or Firm* — Buchanan Ingersoll & Rooney PC

(57) ABSTRACT

The invention relates to a component for a thermal machine, in particular a gas turbine, which includes a corner and/or edge subjected to a thermally high load. The cooling of the component is improved in a manner such that at least one cooling channel is countersunk into the surface of the component in the immediate vicinity of the corner and/or edge in order to cool the corner and/or edge.

20 Claims, 4 Drawing Sheets

(52) U.S. Cl.
CPC ..... *F01D 25/12* (2013.01); *F05D 2230/10* (2013.01); *F05D 2240/81* (2013.01); *F05D 2260/20* (2013.01); *F05D 2260/208* (2013.01)

(56) References Cited

U.S. PATENT DOCUMENTS

| | | | | |
|---|---|---|---|---|
| 7,553,534 | B2 * | 6/2009 | Bunker | F01D 5/186 415/115 |
| 7,597,536 | B1 * | 10/2009 | Liang | F01D 5/147 415/115 |
| 8,105,030 | B2 * | 1/2012 | Abdel-Messeh | F01D 5/187 415/115 |
| 8,668,454 | B2 * | 3/2014 | Wiebe | F01D 5/18 416/97 R |
| 8,951,015 | B2 * | 2/2015 | Brandl | F01D 5/147 416/193 A |
| 2011/0223004 | A1 | 9/2011 | Lacy et al. | |

FOREIGN PATENT DOCUMENTS

| | | | | |
|---|---|---|---|---|
| EP | 1 905 950 | A1 | 4/2008 | |
| EP | 1 927 727 | A2 | 6/2008 | |
| EP | 2 189 626 | A1 | 5/2010 | |
| EP | 2 365 187 | A2 | 9/2011 | |
| GB | 2136886 | A * | 9/1984 | F01D 25/125 |
| GB | 2 298 246 | A | 8/1996 | |
| JP | S53-74613 | | 7/1978 | |
| JP | 2010144656 | A | 7/2010 | |
| JP | 2010-267282 | A | 11/2010 | |
| JP | 2011-185271 | A | 9/2011 | |

OTHER PUBLICATIONS

Translation of Notification of Reasons for Refusal dated Oct. 31, 2016 in corresponding Japanese Patent Application No. 2014-557058 (7 pages).

* cited by examiner

COMPONENT FOR A THERMAL MACHINE, IN PARTICULAR A GAS TURBINE

CROSS-REFERENCE TO RELATED APPLICATIONS

This application claims priority to PCT/EP2013/053116 filed Feb. 15, 2013, which claims priority to Swiss application 00210/12 filed Feb. 17, 2012, both of which are hereby incorporated in their entireties.

TECHNICAL FIELD

The present invention relates to the field of thermal machines. It concerns a component for a thermal machine, in particular for a gas turbine.

BACKGROUND

In the case of thermal machines, in particular gas turbines, there are various components that on the one hand have corners and edges as a result of their structural design and on the other hand are exposed to high thermal loading at these places during operation. An example of such a component is a moving blade of a gas turbine, made up of multiple parts, such as that disclosed for example in the document EP 2 189 626 A1. FIGS. 1 and 2 of this document are reproduced as FIG. 1 in the present application.

The parts shown in FIGS. 1A and 1B, a platform element 10 and a blade airfoil element 20, are assembled and connected to one another to form a moving blade. The platform element 10 has in the upper side 11 a through-opening 12, through which the blade airfoil element 20 can be fitted with the blade airfoil 17, ending in a blade tip 18. Serving for securing the assembled blade are legs 13, 14 with formed-on hooks 15, 16 on the underside of the platform element 10 and a blade root 21 on the blade airfoil element 20, which is connected to the blade airfoil 17 by way of a shaft 19.

In the assembled state, there is a transition between the blade airfoil 17 and the upper side 11 of the platform element 10, which is shown enlarged and in section in FIG. 2. A gap 23, which is formed between the parts 17 and 11 and is subjected to the hot gas flowing around the blade airfoil 17, produces an edge 22 with a corner region 24, which is subjected to high thermal loading.

Until now, this edge 22 (running perpendicularly to the plane of the drawing in FIG. 2) has been cooled by a cast cooling channel being provided parallel to the edge 22. However, such a cooling channel is not very efficient, because a) with a cast channel, the distance from the surface is comparatively great, which leads to higher temperatures in the corner region 24; and b) with a cast channel, the inside diameter is comparatively great, which leads to a higher consumption of cooling air.

For this reason, oxidation and crack formation occur to a not inconsiderable extent at the edge 22 because of inadequate cooling.

To solve this problem, it has already been proposed (see the document JP 2010144656 or U.S. Pat. No. 7,597,536 B1) to reduce the extent to which the edge is subjected to hot gas by for example providing flushing with cooling air. The disadvantage of this is that a considerable amount of flushing air is required to keep down the temperature of the mixed hot gas. In particular in the case of relatively large gaps, the required amount of flushing air increases significantly. If the gap width changes during operation in a way that does not correspond to the desired amount of flushing air, this type of cooling becomes ineffective. In the worst case, the flushing air may flow directly into the main stream, if the flow conditions change during operation. For these reasons, the gap is left largely without cooling, because both solution proposals presuppose a balanced mixture of hot gas penetrating into the gap and flushing air supplied through bores.

SUMMARY

An object of the invention is to provide a component of the type mentioned at the beginning that avoids the disadvantages of known components and is always sufficiently cooled in the region of corners or edges that are subjected to high thermal loading, while expending a small amount of coolant.

The component according to the invention, which is intended for a thermal machine, in particular a gas turbine, and has a corner or edge that is subjected to high thermal loading, is characterized in that, for cooling the corner or edge, at least one cooling channel recessed into the component from the surface is arranged in the direct vicinity of the corner or edge.

An embodiment of the component according to the invention is characterized in that the corner or edge extends along a predetermined line, and in that the at least one cooling channel runs substantially parallel to the corner or edge over a predetermined distance.

Another embodiment is distinguished by the fact that several parallel-running, recessed cooling channels are arranged in the direct vicinity of the corner or edge.

A further embodiment is characterized in that the cooling channels respectively comprise a cooling tube introduced into a groove.

In particular, the cooling tube is respectively embedded in a filling material filling the groove and is thereby thermally coupled to the surrounding material of the component.

Another embodiment is distinguished by the fact that the groove with the introduced cooling tube is closed with respect to the surface to be cooled.

In particular, a welded-on covering layer is provided for closing the groove.

A further embodiment of the invention is characterized in that the cooling channel has a distance of its central axis from the surface to be cooled in the region of 1 mm.

According to another embodiment, the cooling channel has an inside diameter in the region of approximately 1 mm.

Yet another embodiment of the invention is characterized in that the cooling channel has an outlet on the side of the surface to be cooled and an inlet on the opposite side.

According to a further embodiment, the component is provided with a thermal barrier coating. This comes into consideration in particular for components that are subjected to high thermal loading, for example those in a gas turbine.

According to another embodiment, the component is formed as a blade of a gas turbine.

In particular, the blade is assembled from separate components, the corner or edge to be cooled being formed at a transition between the separate components.

The corner or edge may in this case be bounded on one side by a gap that is flooded by the hot gas

BRIEF DESCRIPTION OF THE DRAWINGS

The invention is to be explained in more detail below on the basis of exemplary embodiments in conjunction with the drawing, in which.

DETAILED DESCRIPTION

Figure 2:
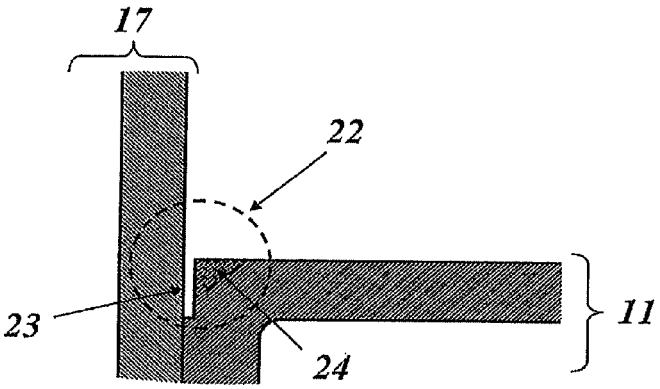
Fig. 2 Prior Art
FIG. 2 shows in section a corner or edge of the blade from FIGS. 1A and 1B that is subjected to high thermal loading.

According to the invention, a technology of cooling channels recessed near the surface is used for the cooling of corners or edges of gas turbine components that are subjected to high thermal loading, such as for example moving blades, stationary blades or heat shields. In the case of a configuration according to FIG. 2, there is the problem that the edge 22 is exposed to hot gas from two surface areas butting one against the other, and is consequently subjected to particularly high thermal loading in the corner region 24.

Figure 3:
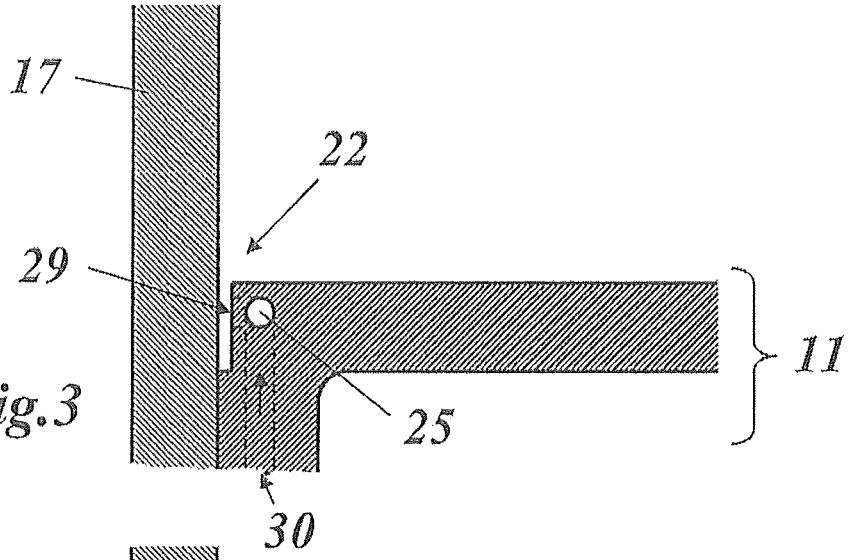
FIGS. 3-5 show various exemplary embodiments of a cooling of the corner or edge from FIG. 2 according to the invention.

According to FIG. 3, a cooling channel 25 running parallel to the edge 22 and having a small inside diameter is then provided in the edge region directly beneath the surface, in order to cool the corner region 24 effectively and with reduced use of coolant, generally cooling air. The inlet 30 and the outlet 29 of the cooling channel 25 are indicated in FIG. 3 by dashed lines.

The cooling channel 25 starts (with the inlet 30) from a plenum filled with cooling air, then runs parallel to the edge 22 to be cooled and then emits the heated air via the outlet 29 into the gap 23. The outlet 29 may, however, also lead to the surface, in order to let out the heated air directly into the stream of hot gas and produce on the surface a film of cooling air constituting film cooling.

Figure 4:
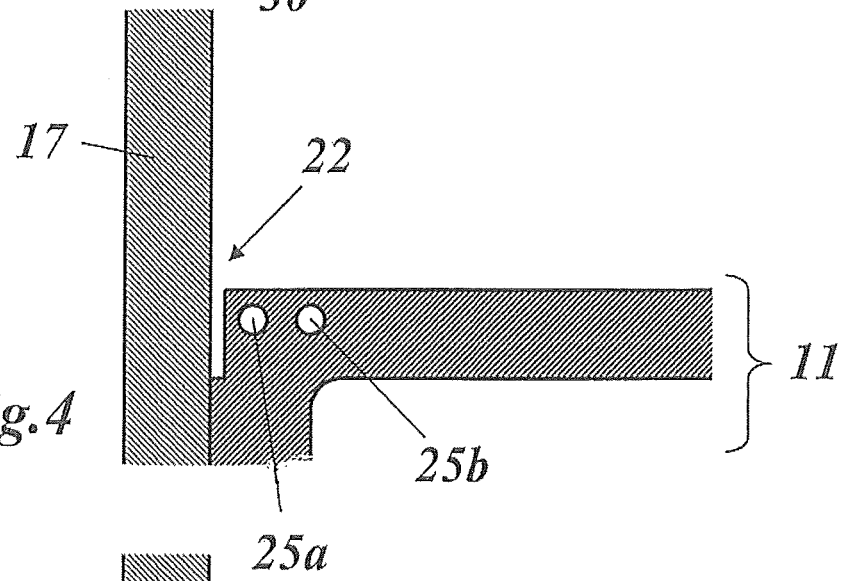
Figure 5:
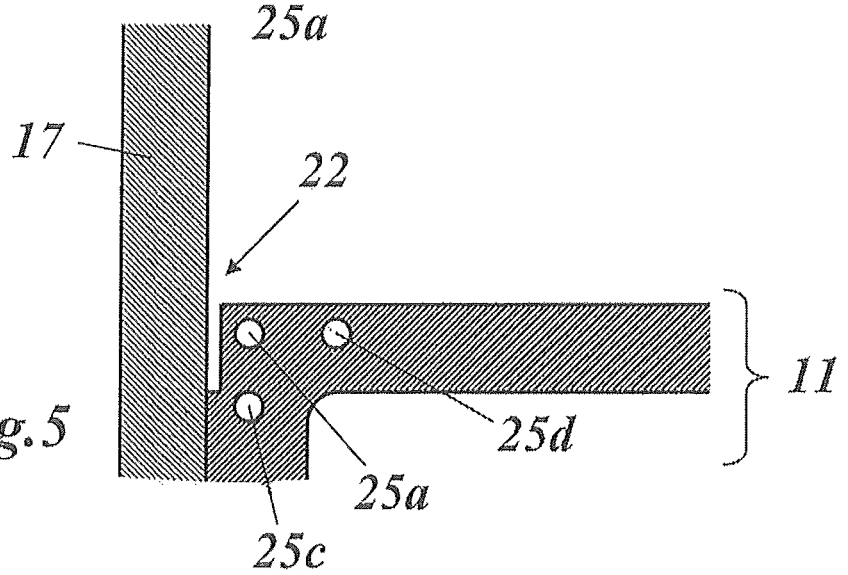

Should a single cooling channel 25 according to FIG. 3 not be sufficient to cool the edge 22, two parallel-running cooling channels 25*a* and 25*b*, which are correspondingly connected to the plenum and the hot gas channel, may be provided according to FIG. 4. Should this also be insufficient, more than two cooling channels 25*a*, 25*c* and 25*d* may run parallel to the edge 22 according to FIG. 5.

Figure 6:
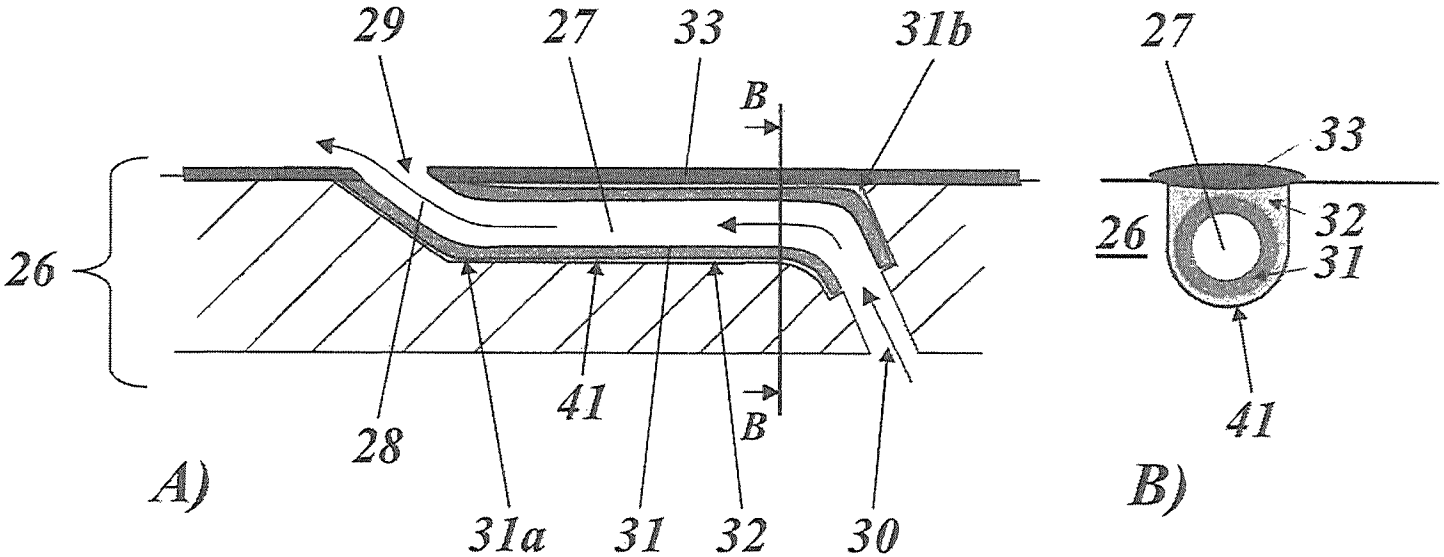
FIG. 6 shows in longitudinal section (A) and cross section (B) a cooling channel configuration given by way of example for the corner cooling according to the invention.

The basic method by means of which thin cooling channels can be subsequently introduced from the surface into a preformed component very close to the surface to be cooled is illustrated on the basis of FIG. 6, FIG. 6 (A) showing the longitudinal section through an arrangement given by way of example, and FIG. 6 (B) showing the cross section in the plane B-B: a groove 41 is introduced into a component 26 from the upper side by a suitable method (for example die sinking) with a suitably formed tool, the groove being introduced into the wall of the component that at one end runs out obliquely upward with a bend 31*a* (outlet 29) and at the other end has after a bend 31*b* a passage to the underside (inlet 30). A correspondingly dimensioned and shaped cooling tube 31 is introduced into the groove formed in this way and is thermally closely coupled to the surrounding material of the component 26 by means of a filling material 32 (for example brazing alloy or the like). The arrangement thus formed can then be closed, in that a covering layer 33 is applied by welding. It forms a cooling channel 27 near the surface, through which the cooling medium 28, for example cooling air, flows during operation.

The cooling channel 27 produced in this way has for example a distance from the central axis to the surface in the region of 1 mm, with an inside diameter in the region of approximately 1 mm. Its length generally lies in a range from 10 mm to 100 mm, preferably 20 mm to 40 mm. In the case of channel lengths beyond that, a plurality of cooling channels 27 are arranged in series, as is shown by way of example in FIGS. 7 and 8. Successive cooling channels 27 may differ from one another in their length, in order for example to make allowance for different thermal stresses or design constraints. In the interests of an optimum cooling effect, they may be flowed through by the cooling medium in the same direction or in opposite directions. The same also applies to cooling channels arranged in parallel.

Figure 7:
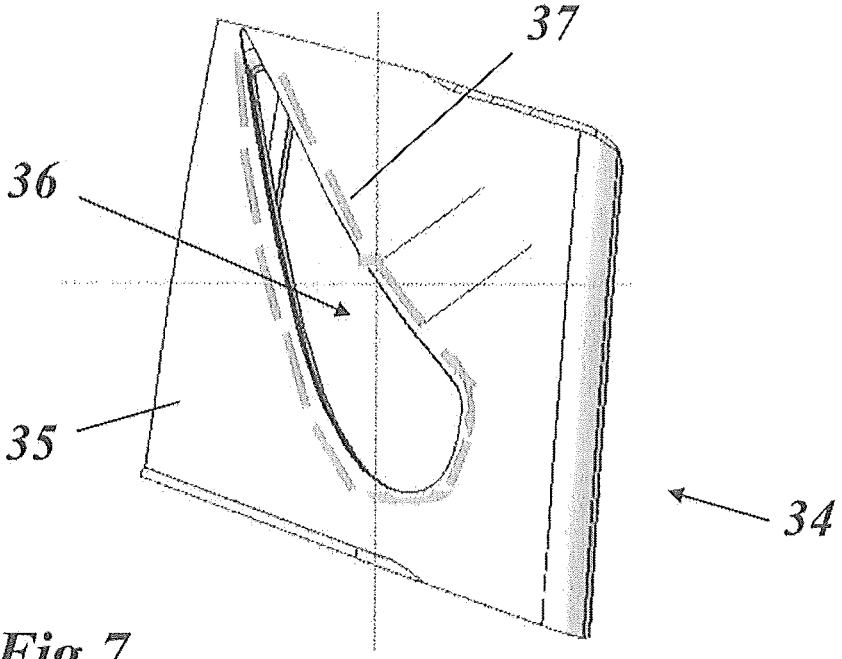
FIG. 7 shows in plan view from above a platform with a constructed blade with a peripheral cooling channel according to the invention.

In the case of a platform element 34 according to FIG. 7, which has on the upper side 35 a through-opening 36, which is bordered by an arcuate curve that resembles a blade profile, the at least one cooling channel 37 according to the invention must be made to replicate this arcuate curve. A number of cooling channels 37 arranged one behind the other, which may also be formed in an arcuate manner, follow the contour of the curve. The actual length of the individual channels 37 depends in particular on the thermal loading of the platform element 34. It will generally be between 20 mm and 40 mm.

Figure 1A:
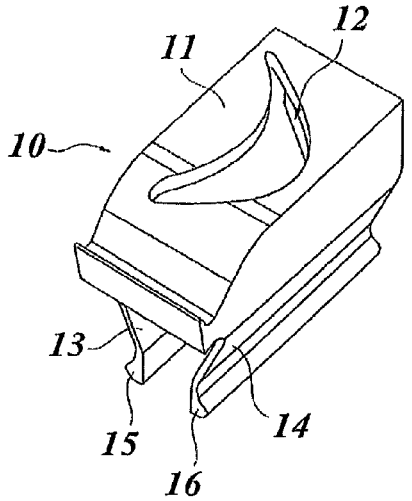
Fig. 1A Prior Art
FIGS. 1A and 1B show parts of an assembly for a moving blade of a gas turbine known from the document EP 2 189 626 A1, to which the invention can be applied.
Figure 1B:
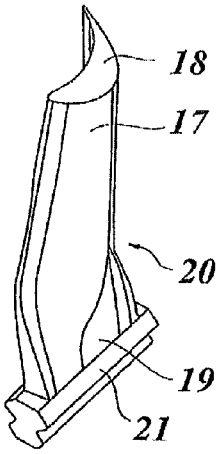
Fig. 1B Prior Art
Figure 8:
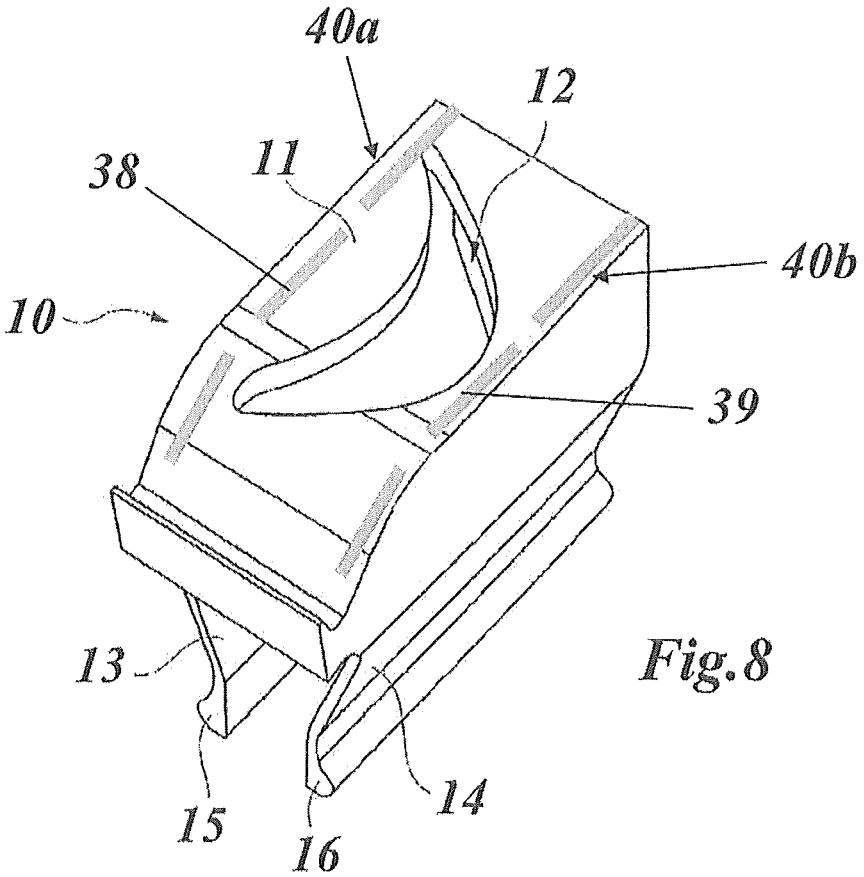
FIG. 8 shows corner cooling channels according to the invention at the outer corners or edges of the platform element from FIG. 1.

In the case of a platform element according to FIG. 1, however, cooling air channels according to the invention may also be used at the outer edges, as is indicated in FIG. 8 for the cooling channels 38 and 39.

The advantages of the invention can be summarized as follows:

a) the efficiency of the machine is improved by reduced cooling air consumption;

b) the cooling takes place as close as possible to the location to be cooled;

c) the corners or edges that are subjected to high thermal loading, which are formed at annular surfaces butting against one another and as a result are subjected to particularly high loading, are cooled effectively; and d) the service life of the component that is cooled in this way is extended significantly.

The invention claimed is:

1. A component for a thermal machine, comprising:

a corner or edge that is subjected to high thermal loading; and at least one cooling channel recessed into the component from a surface of the component, the at least one cooling channel arranged in the direct vicinity of the corner or edge for cooling the corner or edge;

wherein the at least one cooling channel includes a cooling tube introduced into the at least one cooling channel and the cooling tube has an outlet configured to cool the surface of the component and an inlet.

2. The component as claimed in claim 1, wherein the corner or edge extends along a preset line, and in that the at least one cooling channel runs substantially parallel to the corner or edge over a predetermined distance.

3. The component as claimed in claim 1, comprising:

several cooling channels arranged in series in the direct vicinity of the corner or edge.

4. The component as claimed in claim 1, comprising:

several parallel-running, recessed cooling channels arranged in the direct vicinity of the corner or edge.

5. The component as claimed in claim 4, wherein the parallel-running cooling channels are arranged offset in relation to one another.

6. The component as claimed in claim 1, wherein the cooling tube is respectively embedded in a filling material filling the at least cooling channel and is thereby thermally coupled to the surrounding material of the component.

7. The component as claimed in claim 1, wherein the at least one cooling channel with the introduced cooling tube is closed with respect to the surface of the component.

8. The component as claimed in claim 7, comprising:

a welded-on covering layer is provided for closing the at least one cooling channel.

9. The component as claimed in claim 1, wherein the at least one cooling channel has a distance of its central axis from the surface of the component in the region of 1 mm.

10. The component as claimed in claim 9, wherein the at least one cooling channel has an inside diameter in the region of approximately 1 mm.

11. The component as claimed in claim 1, comprising:

a thermal barrier coating applied on the surface of the component.

12. The component as claimed in claim 1, wherein it is formed as a blade of a gas turbine.

13. The component as claimed in claim 12, wherein the blade is assembled from separate components, and the corner or edge to be cooled is formed at a transition between the separate components.

14. The component as claimed in claim 13, wherein the corner or edge is bounded on one side by a gap that is subjected to hot gas.

15. A gas turbine including a component, the component comprising:

a corner or edge that is subjected to high thermal loading; and at least one cooling channel recessed into the component from a surface of the component, the at least one cooling channel arranged in the direct vicinity of the corner or edge for cooling the corner or edge;

wherein the cooling channel includes a cooling tube introduced into the at least one cooling channel and the cooling tube has an outlet configured to cool the surface of the component and an inlet.

16. The component as claimed in claim 15, wherein the corner or edge extends along a preset line, and in that the at least one cooling channel runs substantially parallel to the corner or edge over a predetermined distance.

17. The component as claimed in claim 15, wherein the cooling tube is respectively embedded in a filling material filling the at least one cooling channel and is thereby thermally coupled to the surrounding material of the component.

18. The component as claimed in claim 15, wherein the at least one cooling channel with the introduced cooling tube is closed with respect to the surface of the component.

19. The component as claimed in claim 15, wherein the at least one cooling channel has an inside diameter in the region of approximately 1 mm.

20. The component as claimed in claim 15, wherein the corner or edge is bounded on one side by a gap that is subjected to hot gas.

* * * * *